US012564257B2

(12) United States Patent
Lee et al.

(10) Patent No.: US 12,564,257 B2
(45) Date of Patent: Mar. 3, 2026

(54) REFILL UNIT FOR SUNSCREEN AND REFILLABLE STICK CONTAINER HAVING THE SAME

(71) Applicant: SAMHWA CO., LTD, Uiwang-si (KR)

(72) Inventors: Kyungchang Lee, Uiwang-si (KR); Kwan Ho Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 18/903,335

(22) Filed: Oct. 1, 2024

(65) Prior Publication Data

US 2025/0127278 A1 Apr. 24, 2025

(30) Foreign Application Priority Data

Oct. 20, 2023 (KR) ..... 10-2023-0140963

(51) Int. Cl.
*A45D 40/04* (2006.01)
*A45D 40/16* (2006.01)

(52) U.S. Cl.
CPC ..... *A45D 40/04* (2013.01); *A45D 40/16* (2013.01)

(58) Field of Classification Search
CPC .... A45D 2040/0031; A45D 2040/0043; A45D 2040/204
See application file for complete search history.

(56) References Cited

U.S. PATENT DOCUMENTS 11,712,100 B2 * 8/2023 Arora ..... A45D 40/00 401/98
11,857,057 B2 * 1/2024 Chen ..... A45D 40/04
11,998,101 B1 * 6/2024 Wise ..... B29C 39/003

* cited by examiner

*Primary Examiner* — David P Angwin
*Assistant Examiner* — Bradley S Oliver
(74) *Attorney, Agent, or Firm* — Bridgeway IP Law Group, PLLC; Jihun Kim

(57) ABSTRACT

A refill unit and a refillable stick container that allow a refilling of a stick type sunscreen product are disclosed. The refill unit includes: an elevation shell that extends a particular length along a left-right direction, extends a particular length along a vertical direction, and forms a shell space on its inside; and a holder that is arranged within the shell space and to be movable along a vertical direction. The elevation shell includes: a shell body that forms the shell space and in a lower surface of which an insertion hole is formed; and a shell-side coupler part, at a lower portion of which is formed a shell ledge protruding in a horizontal direction. The holder may include: a holder body arranged within the shell space; and a holder-side coupler part that extends down at a position corresponding to a center of the insertion hole.

12 Claims, 10 Drawing Sheets

2000

REFILL UNIT FOR SUNSCREEN AND REFILLABLE STICK CONTAINER HAVING THE SAME

CROSS-REFERENCE TO RELATED APPLICATIONS

This application claims the benefit of Korean Patent Application No. 10-2023-0140963, filed with the Korean Intellectual Property Office on Oct. 20, 2023, the disclosure of which is incorporated herein by reference in its entirety.

BACKGROUND

1. Technical Field

The present invention relates to a container for a sunscreen, more particularly to a refill unit for sunscreen and a refillable stick container having the same that allows a refilling of a stick type sunscreen product.

2. Description of the Related Art

A stick type product refers to a product in which a composition containing the needed ingredients is congealed in the form of a stick. A container for a stick type product is typically provided as a structure that keeps most of the stick material within the container while allowing the user to make a manipulation as necessary which exposes a portion of the stick to the outside. That is, as the stick type product is used and the exposed upper portion of the stick is expended, the upper portion of the stick may be worn away, and the stick may gradually be decreased in height. As a result, the stick type container would have to move the stick further upward if the stick is to maintain an exposed state. In addition to cosmetic products such as lipsticks and lip balms, various other products such as sunscreens, deodorants, glues, ointments, etc., are being provided in the form of stick type products.

Typically, a stick type product is carried on the person of the user and is thus manufactured in a relatively small size. The small size of the stick type product limits the amount of usable content and requires a higher degree of precision in manufacturing the stick container. Since use of the stick material requires a complicated structure for moving the stick up and down as described above, the manufacturing cost for the stick container is higher than that for a regular container. If the stick container were to be fabricated in a refillable form, so that the stick container having a complicated structure and requiring a high manufacturing cost may be reused even after the stick material is used up, then it would be possible to greatly reduce waste.

Among the types of stick type products is the stick type sunscreen, also referred to as a "sun stick". Every time it is used, the sun stick is applied over a relatively large area and thus has the stick material manufactured with a large width. Therefore, manufacturing a stick container for a sunscreen, deodorant, etc., in a refillable form would require that the refill unit be firmly secured over the entire width of the stick material.

SUMMARY OF THE INVENTION

An aspect of the present invention, which was conceived to resolve the problem described above, is to provide a refill unit and a refillable stick container that can provide a high coupling strength while enabling a simple way of refilling.

Other objectives of the present invention will be more clearly understood from the embodiments set forth below.

One aspect of the invention provides a refill unit that is configured to move in a front direction for coupling with a container assembly. The refill unit may include: an elevation shell that extends a particular length along a left-right direction, extends a particular length along a vertical direction, and forms a shell space on its inside, which is open at the top; and a holder that is arranged within the shell space and to be movable along a vertical direction. The elevation shell may include: a shell body that forms the shell space and in a lower surface of which an insertion hole is formed; and a shell-side coupler part that extends down from a lower surface of the shell body and at a lower portion of which is formed a shell ledge protruding in a horizontal direction. The holder may include: a holder body arranged within the shell space; and a holder-side coupler part that extends down from a lower surface of the holder body at a position corresponding to a center of the insertion hole, where the holder-side coupler part may include a holder ledge formed at a lower portion thereof that protrudes in a horizontal direction. Here, when the holder is at a lowest position within the shell space, the holder-side coupler part can be exposed through the insertion hole below the lower surface of the shell body, and when the refill unit is moved in the front direction towards the container assembly while the holder is at the lowest position within the shell space, the shell-side coupler part can be coupled with a connector of the container assembly, and the holder-side coupler part can be coupled with a shaft of the container assembly.

A refill unit according to an embodiment of the present invention can include one or more of the following features. For example, a first alignment protrusion can be formed on the lower surface of the holder body at a position corresponding to an edge of the insertion hole, with the first alignment protrusion extending down such that the holder-side coupler part is at an inner side of the first alignment protrusion, and when the holder is at the lowest position within the shell space, the first alignment protrusion can be inserted in the insertion hole.

An alignment hole can be formed in the lower surface of the shell body, the shell-side coupler part can be formed in a shape surrounding the alignment hole, a second alignment protrusion can be formed on the lower surface of the holder body, and when the holder is at the lowest position within the shell space, the second alignment protrusion can be inserted in the alignment hole.

The elevation shell can further include a stopper block that extends down from a lower portion on a rear side of the shell body to cover a rear side of the shell-side coupler part, where the stopper block can include a stopper surface on either or both of the left and right sides that faces a front direction.

In cases where the shell ledge protrudes outward from the lower portion of the shell-side coupler part, at least one of a detent protrusion and a detent indentation can be formed on an outer perimeter of the shell-side coupler part.

In cases where the shell-side coupler part extends down to form a shell-side coupling space on its inner side and the shell ledge protrudes inward from the lower portion of the shell-side coupler part, the shell-side coupler part can be open at its front side such that the shell-side coupling space is open at the top and at the front. In such cases, at least one of a detent protrusion and a detent indentation can be formed on an inner perimeter of the shell-side coupler part.

Another aspect of the invention provides a refillable stick container that is configured to be coupled with a refill unit such that the refill unit moving in a front direction is coupled to an upper portion of the refillable stick container. The refillable stick container may include: a connector that includes a connector-side coupler part and in an upper surface of which a through hole is formed, where the connector-side coupler part may be configured to be coupled to an elevation shell of the refill unit; a screw guide that is configured to be rotatable in relation to the connector and includes a socket cylinder, where the socket cylinder may form a socket space on its inner side and may include a socket screw formed on its inner perimeter; and a shaft that includes a shaft-side coupler part and an extended body, where the shaft-side coupler part may be positioned above the through hole and may be configured to be coupled to a holder of the refill unit, and the extended body may having at least a portion thereof positioned within the socket space, with the extended body including a shaft screw formed on its surface to mate with the socket screw. The connector-side coupler part can extend up from an upper surface of the connector, and a connector ledge can be formed at an upper portion of the connector-side coupler part, where the connector ledge can protrude in a horizontal direction. The shaft-side coupler part can extend up from an upper portion of the extended body, and a shaft ledge can be formed at an upper portion of the shaft-side coupler part, where the shaft ledge can protrude in a horizontal direction. When the refill is moved in the front direction towards the connector, the connector-side coupler part can be coupled with the elevation shell, and the shaft-side coupler part can be coupled with the holder.

A refillable stick container according to an embodiment of the present invention can include one or more of the following features. For example, the refillable stick container can further include a container body coupled to the connector and the screw guide. The container body can be secured in relation to the connector, and the screw guide can be coupled to the container body such that the screw guide is rotatable relative to the container body.

The shaft-side coupler part can extend up to form a shaft-side coupling space on its inner side, the shaft ledge can protrude inward from the upper portion of the shaft-side coupler part, and the shaft-side coupler part can be open at its rear side such that the shaft-side coupling space is open at the top and at the rear.

The connector can further include a front block that extends up from an upper portion on a front side of the connector to cover a front side of the shaft-side coupler part. The front block can have a contact surface formed on at least one of a left side and a right side with the contact surface facing a rear direction, the refill unit can include a stopper block that includes a stopper surface facing a front side, and the stopper surface can be pressed against the contact surface when the refill unit is coupled.

Yet another aspect of the invention provides a refillable stick container. The refillable stick container may include: an elevation shell that extends a particular length along a left-right direction, extends a particular length along a vertical direction, and forms a shell space on its inside, which is open at the top; a holder that is arranged within the shell space and is configured to be movable along a vertical direction; a connector that includes a connector-side coupler part and in an upper surface of which a through hole is formed, where the connector-side coupler part is configured to be coupled to the elevation shell; a screw guide that is configured to be rotatable relative to the connector and includes a socket cylinder, where the socket cylinder forms a socket space on its inner side and includes a socket screw formed on its inner perimeter; and a shaft that includes a shaft-side coupler part and an extended body, where the shaft-side coupler part is positioned above the through hole and configured to be coupled to the holder, and the extended body has at least a portion positioned within the socket space and includes a shaft screw formed on its surface to mate with the socket screw. Here, the elevation shell can include: a shell body that forms the shell space and in a lower surface of which an insertion hole is formed; and a shell-side coupler part that extends down from a lower surface of the shell body and at a lower portion of which a shell ledge is formed, which protrudes in a horizontal direction. The holder can include: a holder body arranged within the shell space; and a holder-side coupler part that extends down from a lower surface of the holder body at a position corresponding to a center of the insertion hole, where a holder ledge can be formed at a lower portion of the holder-side coupler part and can protrude in a horizontal direction. The connector-side coupler part can extend up from an upper surface of the connector, and a connector ledge can be formed at an upper portion of the connector-side coupler part, with the connector ledge protruding in a horizontal direction. The shaft-side coupler part can extend up from an upper portion of the extended body, and a shaft ledge can be formed at an upper portion of the shaft-side coupler part, with the shaft ledge protruding in a horizontal direction. When the holder is at a lowest position within the shell space, the holder-side coupler part can be exposed through the insertion hole below the lower surface of the shell body, and when the elevation shell is moved in a front direction towards the connector while the holder is at the lowest position within the shell space, the shell ledge can engage the connector ledge such that the shell-side coupler part is coupled with the connector-side coupler part, and the holder ledge can engage the shaft ledge such that the holder-side coupler part is coupled with the shaft-side coupler part.

An embodiment of the present invention having the features above can provide various advantageous effects including the following. However, an embodiment of the present invention may not necessarily exhibit all of the effects below.

A stick container and a refill unit according to an embodiment of the present invention allow a refilling of a stick material such as a sunscreen or deodorant that is elongated along a horizontal direction.

A stick container and a refill unit according to an embodiment of the present invention provide a structure that can be assembled easily but also can maintain a strong coupling strength after the assembly.

DETAILED DESCRIPTION OF THE INVENTION

Figure 1A:
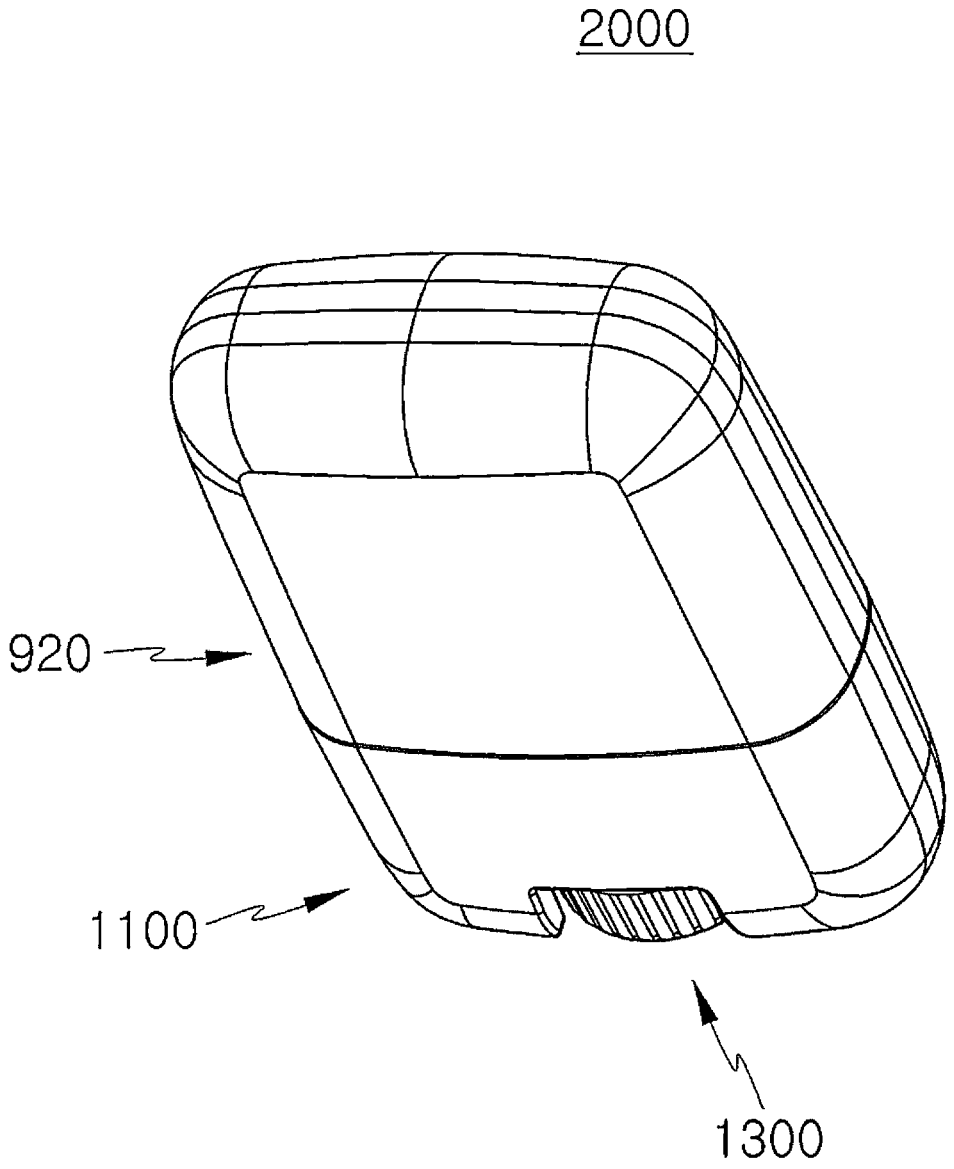
FIG. 1A and FIG. 1B are perspective views illustrating a stick container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

For convenience, the specification uses terms such as "front", "rear", "inner", "outer", "upper", and "lower". In the descriptions below, the direction in which the elevation shell assembly (i.e., the assembly of the elevation shell 600 and the holder 700) is moved to be coupled with the container assembly (i.e., the assembly of the shaft 300, connector 400, container body 1100, screw guide 1200, and dial 1300) is referred to as the "front" or "forward" direction. The "front-rear direction" refers to a direction parallel to the front and rear directions, and the "left-right direction" refers to a direction parallel to the left and right directions, while the "horizontal direction" encompasses both the front-rear direction and the left-right direction. An "inner" side refers to a side closer to the interior of the component being described or of the stick container 2000, whereas an "outer" side refers to a side further away from the interior of the component or stick container 2000. The terms "upper" and "lower" are used to describe the stick container 2000 when it is oriented as in FIG. 2. Of course, when a stick container 2000 according to an embodiment of the invention is actually in use, the directions mentioned in the specification may not coincide with the actual directions of the parts described.

A stick container 2000 according to an embodiment of the invention, as described below, is configured to house a stick material 10, such as a sunscreen, a deodorant, etc., In such cases, it is required that the user be able to apply the stick material 10 quickly over a large area, and as such, the stick material 10 is generally fabricated to have an elongated shape along the left-direction direction.

Figure 1B:
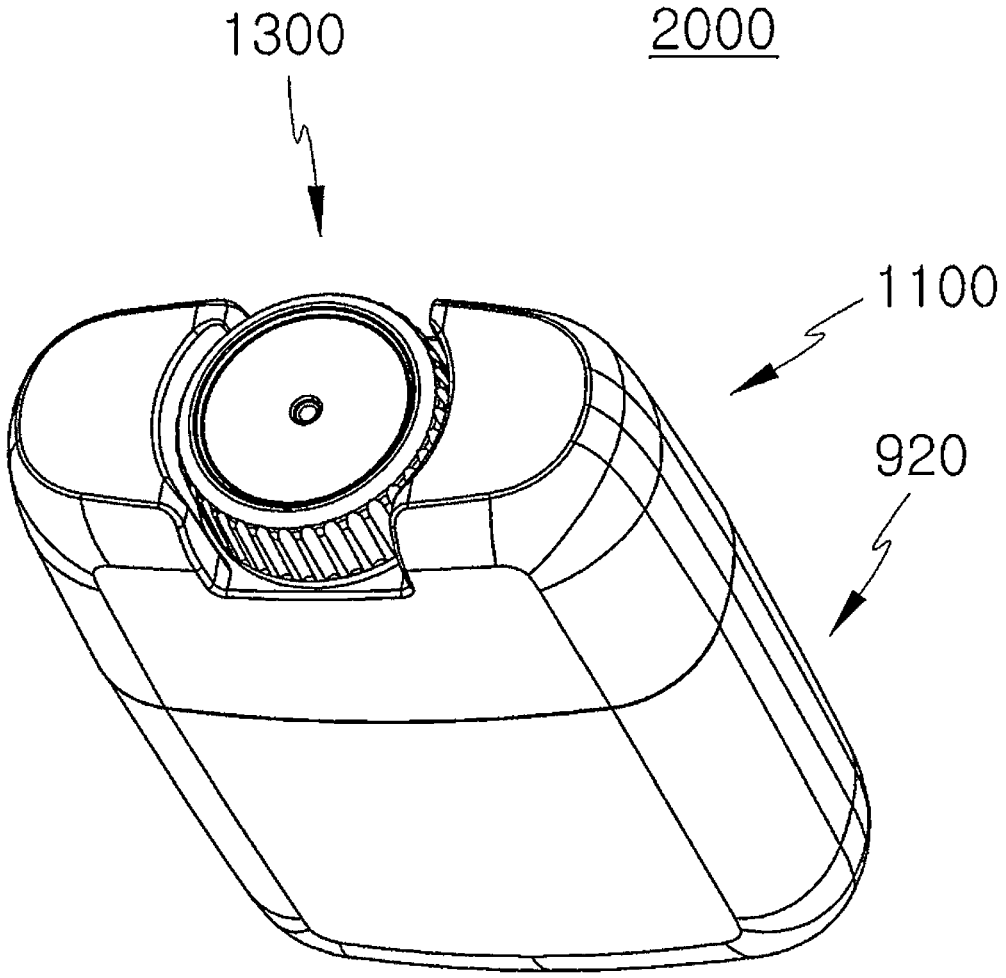
Figure 2:
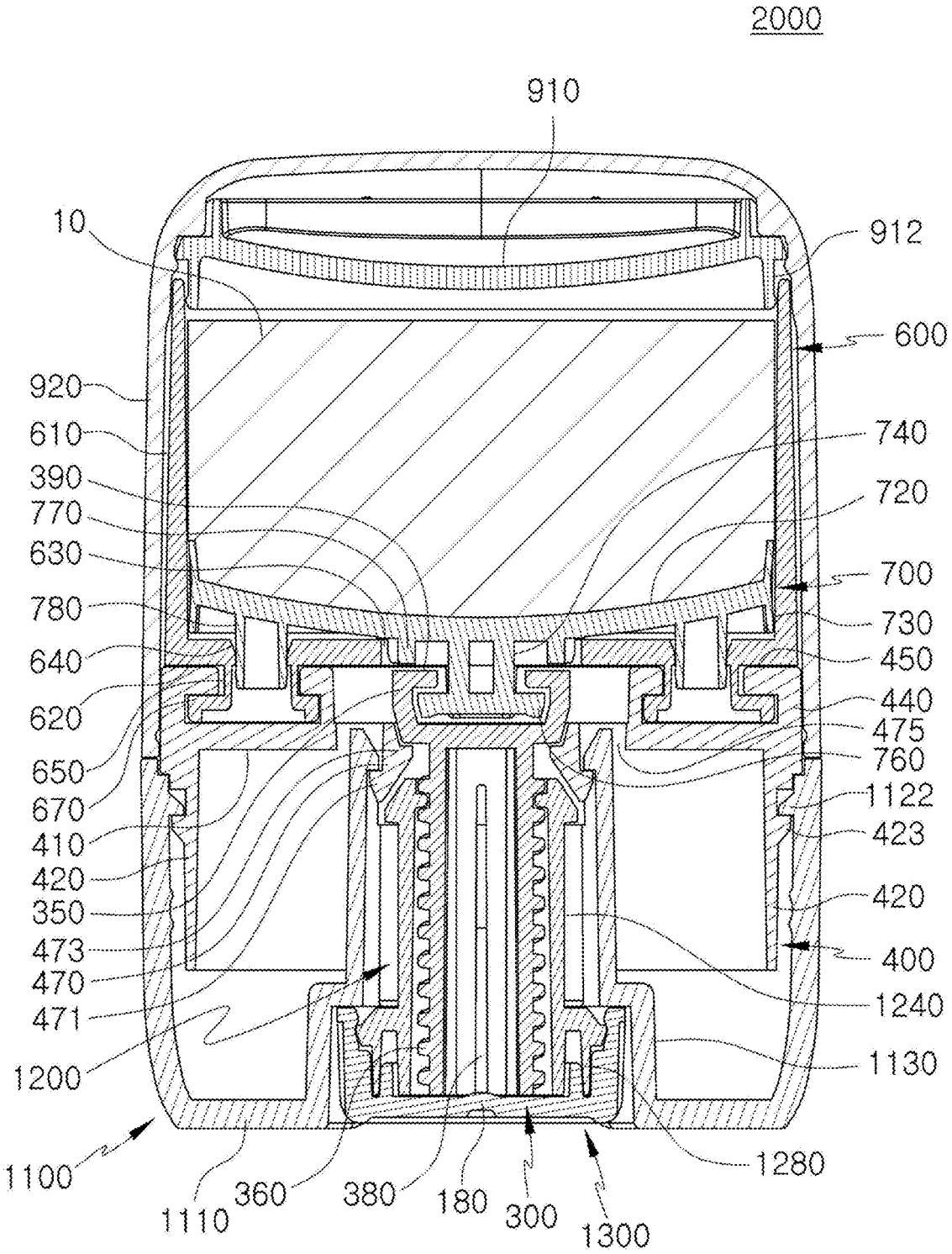
FIG. 2 is a cross-sectional view illustrating a stick container according to an embodiment of the invention.
Figure 3:
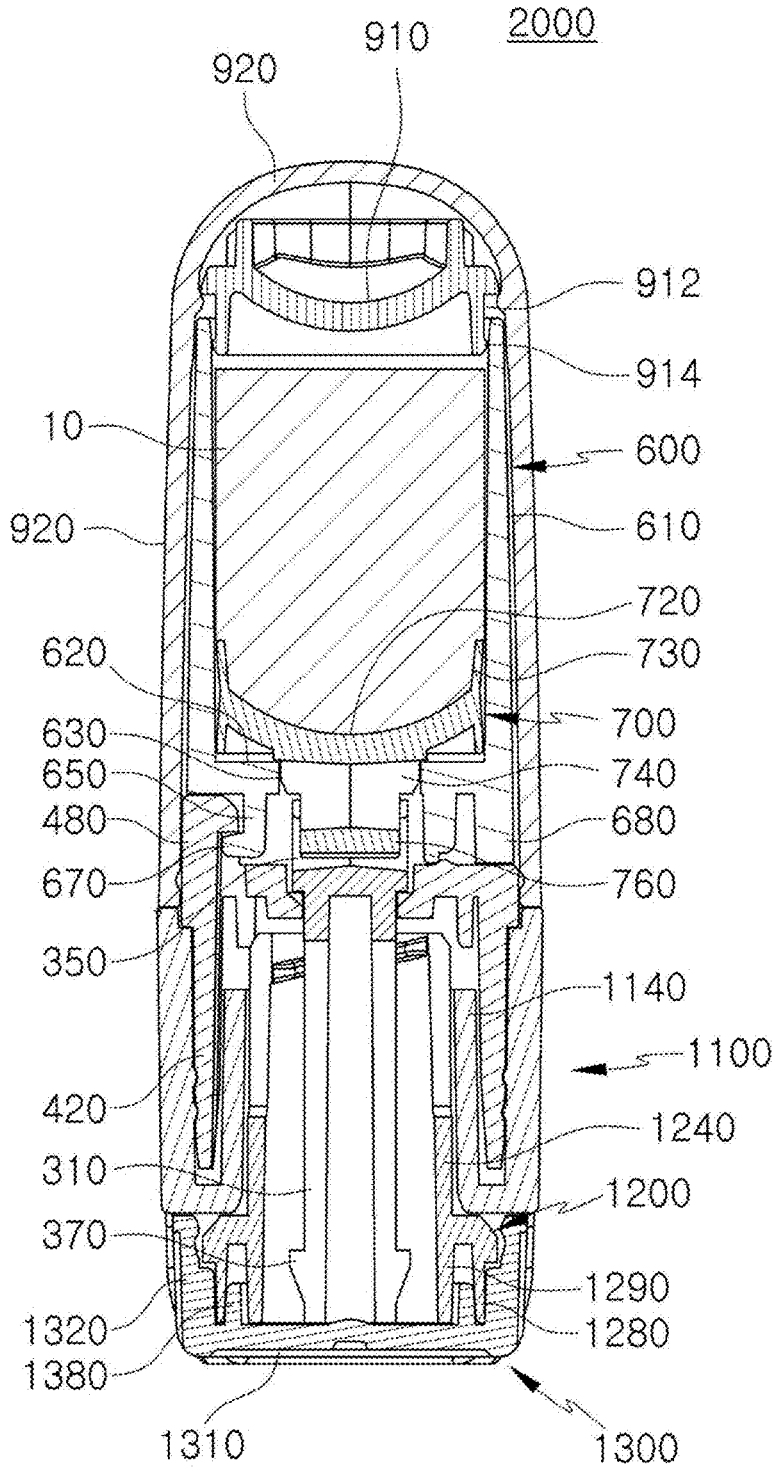
FIG. 3 is a cross-sectional view illustrating a stick container according to an embodiment of the invention.
Figure 4A:
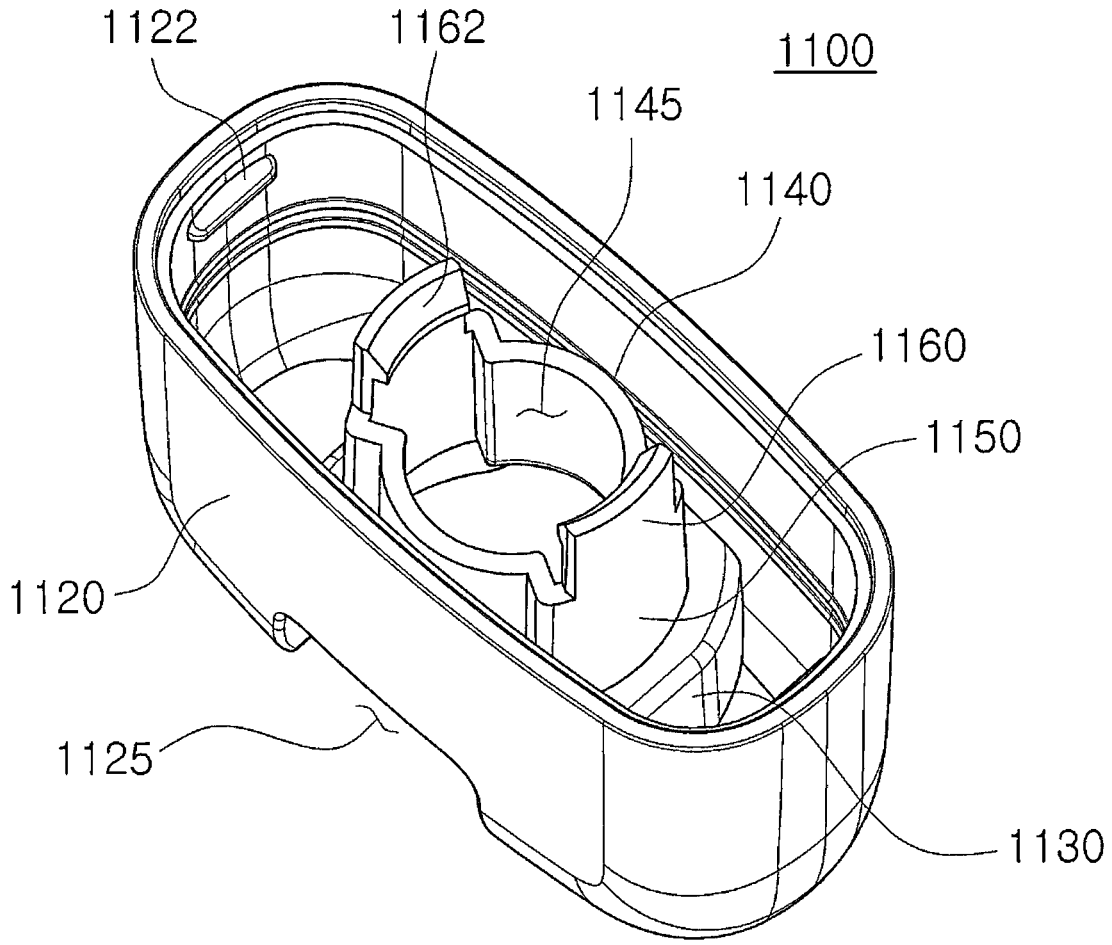
FIG. 4A and FIG. 4B illustrate the container body of a stick container according to an embodiment of the invention.
Figure 4B:
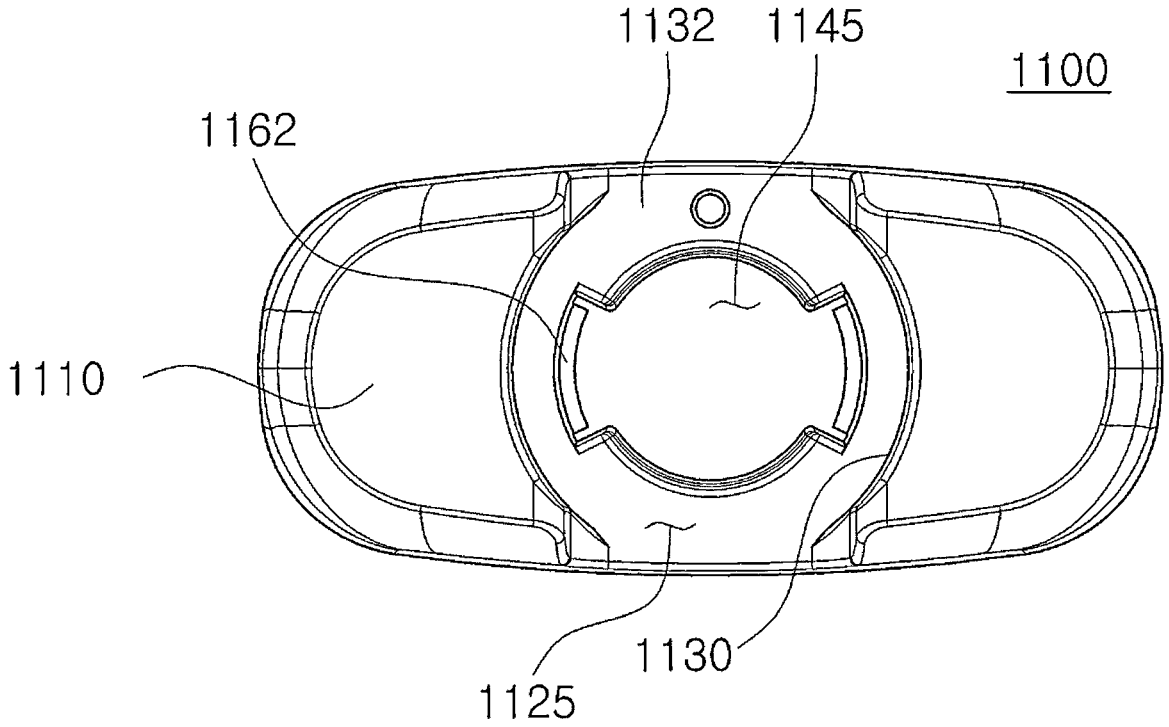
Figure 5A:
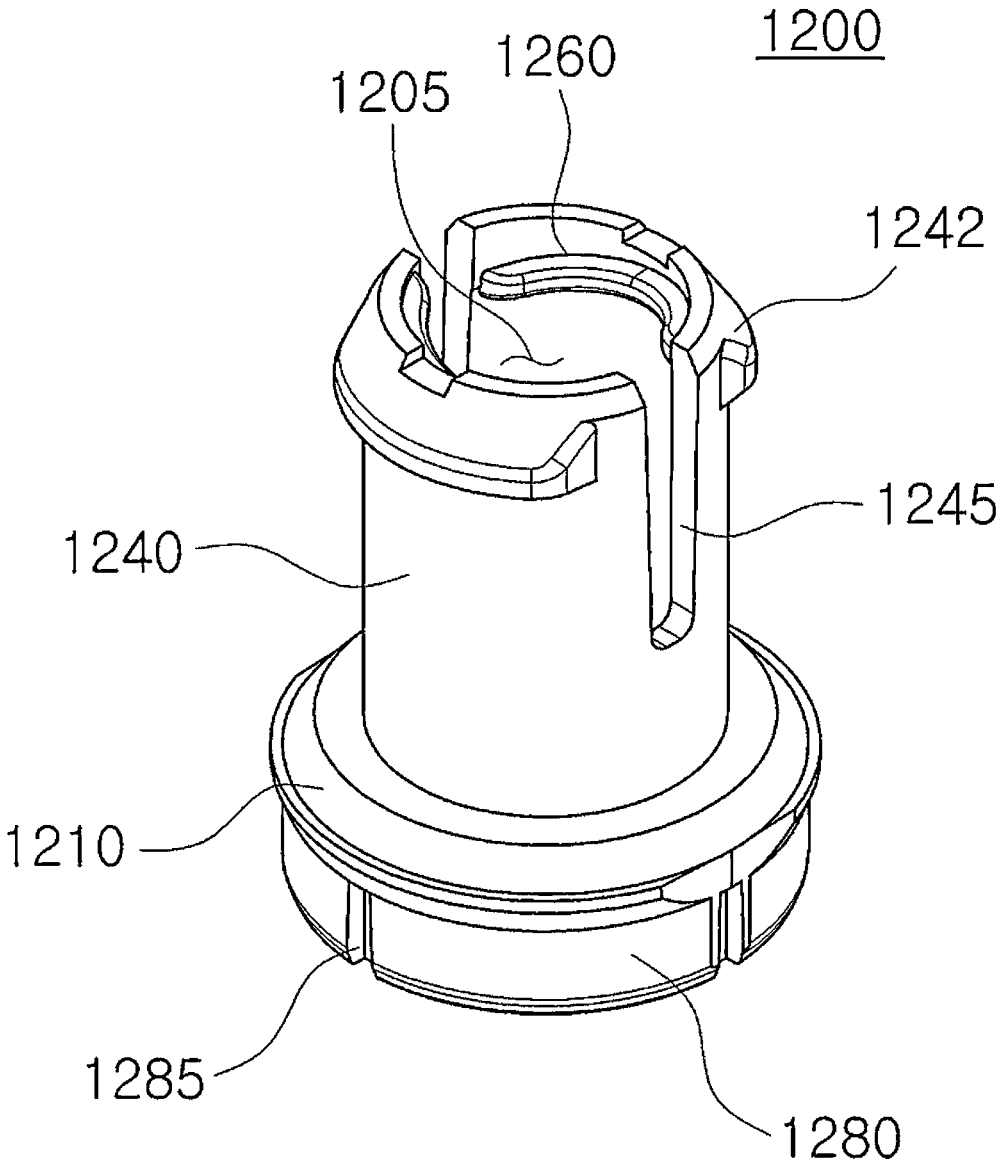
FIG. 5A and FIG. 5B are perspective views illustrating the screw guide of a stick container according to an embodiment of the invention.
Figure 5B:
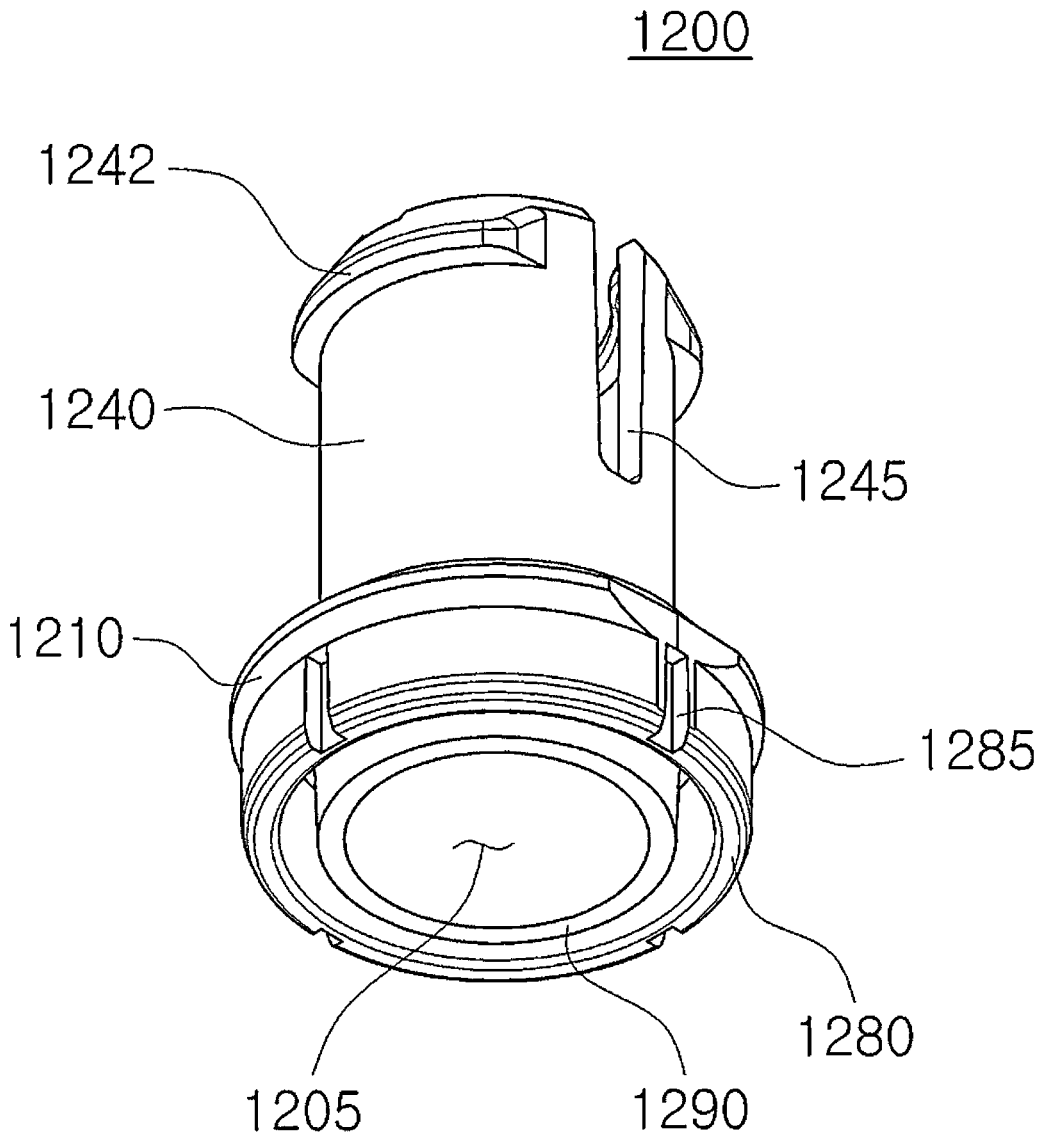
Figure 6:
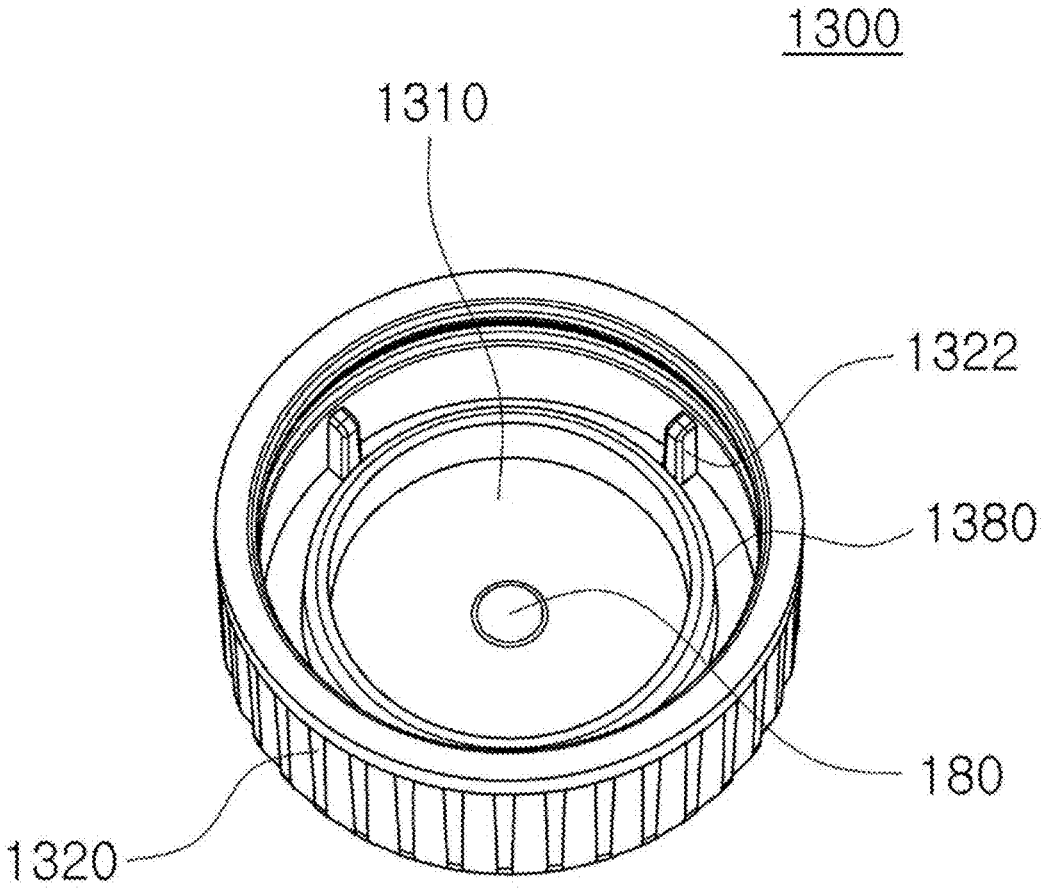
FIG. 6 is a perspective view illustrating the dial of a stick container according to an embodiment of the invention.
Figure 7:
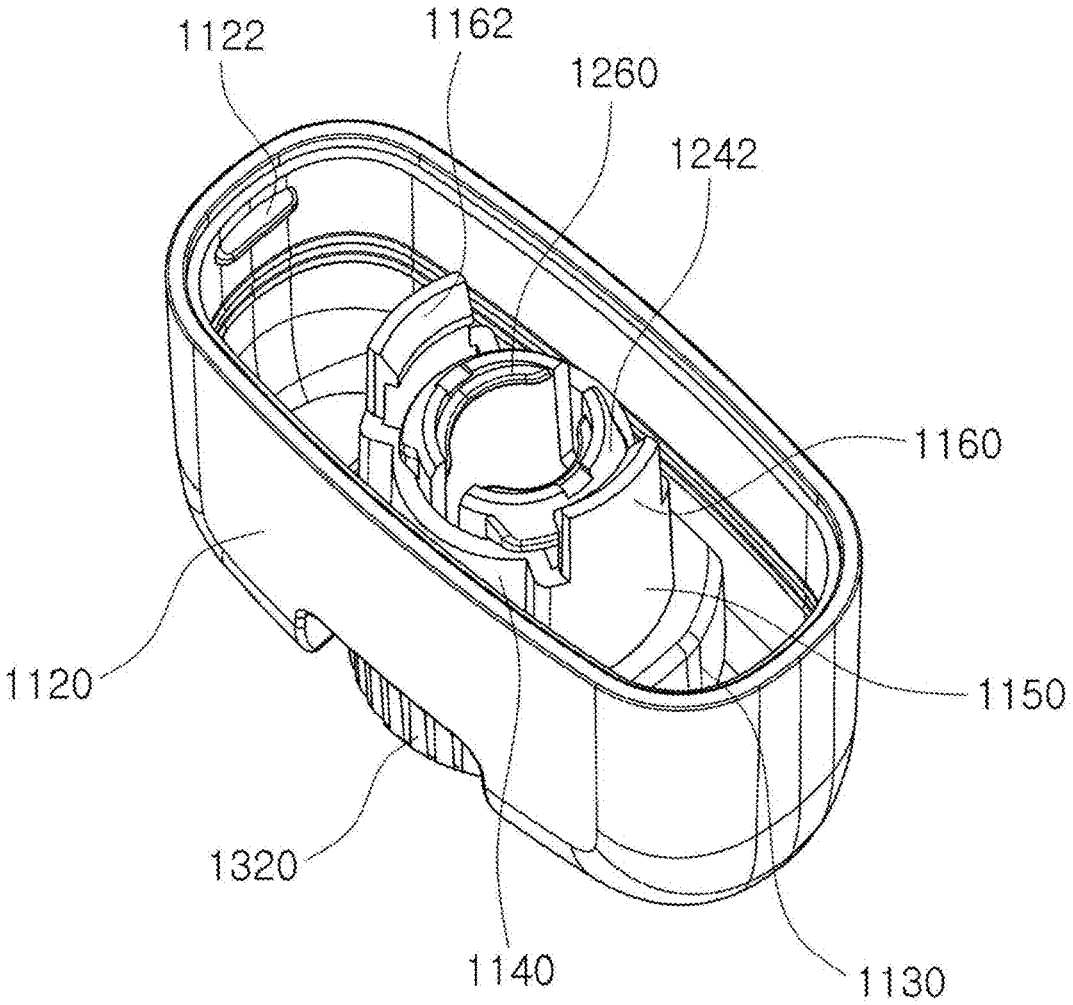
FIG. 7 is a perspective view illustrating the container body, screw guide, and dial of a stick container according to an embodiment of the invention in a coupled state.

FIG. 1A and FIG. 1B are perspective views illustrating a stick container 2000 according to an embodiment of the invention, while FIG. 2 and FIG. 3 are cross-sectional views illustrating the stick container 2000 as cut along the left-right direction and the front-rear direction, respectively. FIG. 4A and FIG. 4B illustrate the container body 1100, FIG. 5A and FIG. 5B illustrate the screw guide 1200, and FIG. 6 illustrates the dial 1300, where the container body 1100, screw guide 1200, and dial 1300 are components of the stick container 2000. FIG. 7 illustrates the container body 1100, screw guide 1200, and dial 1300 in a coupled state.

A stick container 2000 according to an embodiment of the invention corresponds to a container that holds and allows the use of a stick material 10 such as a sunscreen, a deodorant, etc. The stick material 10 can be provided on an upper portion of a holder 700 within an elevation shell 600 and can be moved up and down in accordance with the user's manipulation of rotating a dial 1300. A stick container 2000 according to an embodiment of the invention can include a container assembly, an elevation shell assembly, and a cap assembly. In an embodiment of the invention, the container assembly may refer to a part including the shaft 300, the connector 400, and the screw guide 1200, the elevation shell assembly may refer to a part including the elevation shell 600 and the holder 700, and the cap assembly may refer to a part including an inner cap 910 and an overcap 920. The elevation shell assembly can also form a refill unit that can be distributed separately.

The container assembly of the stick container 2000 may serve to support the elevation shell assembly as well as to move the holder 700 up and down when manipulated by the user. In a stick container 2000 according to an embodiment of the invention, the container assembly can include a shaft 300, a connector 400, a container body 1100, a screw guide 1200, and a dial 1300.

The shaft 300 corresponds to the part which moves along the vertical direction by interacting with the socket screw 1260 of the screw guide 1200 in accordance with the manipulation made by the user. In an embodiment of the invention, the shaft 300 can include an extended body 310, a shaft-side coupler part 350, a shaft screw 360, and brake protrusions 370.

The extended body 310, which is the main part of the shaft 300, can extend along the vertical direction in an elongated shape. The extended body 310 can be configured to be arranged within the socket screw 1260 of the socket cylinder 1240 and pass through the through hole of the connector 400. The extended body 310 can have a cross section that is not circular in shape, in order that the extended body 310 may move up and down along the vertical direction without being rotated relative to the connector 400. For example, in the example shown in the drawings, the cross section of the extended body 310 of the shaft 300 is formed such that it is longer in one direction, with the two longer sides having a flat shape and the two shorter sides forming arc shapes.

The shaft-side coupler part 350 can be positioned over the through hole of the connector 400 and can be configured to couple with the holder-side coupler part 740 of the holder 700. The shaft-side coupler part 350 can extend up from an upper portion of the extended body 310, and a shaft ledge 390 provided on an upper portion of the shaft-side coupler part 350 can protrude in a horizontal direction. In the example illustrated in FIG. 2, the shaft-side coupler part 350 extends upward to form a shaft-side coupling space on its inner side, and the holder-side coupler part 740 is inserted into the shaft-side coupling space. The shaft ledge 390 protrudes inward from the upper portion of the shaft-side coupler part 350 to engage the holder ledge 760 of the holder-side coupler part 740 positioned underneath. Of course, it is possible to have the shaft ledge 390 protrude outward from the shaft-side coupler part 350 and have the holder ledge 760 protrude inward from the holder-side coupler part 740.

The shaft screw 360 can be formed over the entire length of the extended body 310 of the shaft 300, protruding from both sides of the outer perimeter of the extended body 310. That is, the shaft screw 360 can be formed on the shorter sides forming arcs from among the outer perimeter of the extended body 310. It is also possible to have the shaft screw 360 formed only on a certain position of the extended body 310 and form the socket screw 1260 on the inner perimeter of over the entire length of the socket cylinder 1240 instead.

The shaft 300 can be arranged such that the shaft screw 360 mates the socket screw 1260 within the socket cylinder 1240 of the screw guide 1200. When the dial 1300 is rotated by the manipulation of the user, the socket screw 1260 is able to rotate, whereas the shaft 300 is not able to rotate due to the extended body 310, which is configured so as not to be rotatable. Since the socket screw 1260 is rotated, the shaft screw 360 that is in a mating relationship therewith may move along the socket screw 1260, but since the shaft 300 cannot rotate, the shaft screw 360 as well as the shaft 300 to which it belongs may move along the vertical direction without rotating.

The brake protrusions 370 can protrude outward from a lower portion of the extended body 310 at positions other than the positions where the shaft screw 360 is formed. For example, the brake protrusions 370 can be formed on the long sides forming flat surfaces on the lower portion of the extended body 310.

The connector 400 corresponds to the part that connects the container assembly and the elevation shell assembly to each other. In an embodiment of the invention, the elevation shell assembly can form a refill unit by itself, so that when the content is depleted in one stick container 2000, the elevation shell assembly in which the content has been depleted can be replaced with the elevation shell assembly of a new refill unit. Thus, the connector 400 can be configured to detachably couple the elevation shell assembly onto the container assembly. In an embodiment of the invention, the stick material 10 and the elevation shell 600 in which it is housed may be elongated along the left-right direction, and as such. the connector 400 can also be elongated along the left-right direction. The connector 400 can mainly include a connector base 410, a support cylinder 420, connector-side coupler parts 440, inner coupler parts 470, and a front block 480.

The connector base 410 can form the upper surface of the connector 400, and a through hole can be formed in the connector base 410 through which the shaft 300 can pass. The through hole can be formed on the inner side of the inner coupler parts 470. For example, in the example illustrated in FIG. 2, the inner coupler parts 470 are formed on both the left and right sides of the through hole of the connector base 410, and clearance holes 475 are formed on both the left and right sides of the inner coupler parts 470. The through hole can have a shape and size corresponding to the cross section of the extended body 310 so as to allow the extended body 310 to pass. In the example illustrated in FIG. 2, the through hole is formed in a size that the shaft-side coupler part 350 is unable to pass through.

The support cylinder 420 can have a hollow shape that is open at the bottom, and the lower portion of the support cylinder 420 can be inserted into the inner side of the container body 1100. Since the support cylinder 420 does not need to direct contact a rotating component, the support cylinder 420 can have a cross section that is not circular in shape. On the outer surface of the support cylinder 420, coupling protrusions 423 can be formed for coupling with the container body 1100.

The connector-side coupler parts 440 can be positioned at an upper portion of the connector 400 and can be configured to couple with the shell-side coupler parts 650 of the elevation shell 600. In this embodiment, in order to house a stick material 10 having an elongated shape in the left-right direction, the elevation shell 600 and the connector 400 are likewise elongated in the left-right direction. Correspondingly, the connector 400 can have a multiple number of connector-side coupler parts 440. The connector-side coupler parts 440 can each be provided on either side of the through hole in which the shaft 300 is inserted, as in the example illustrated in FIG. 2. In certain embodiments, one of the connector-side coupler parts 440 can be formed to surround the through hole.

Each connector-side coupler part 440 can extend up from the connector base 410, and a connector ledge 450 provided at an upper portion of the connector-side coupler part 440 can protrude in a horizontal direction. In the example illustrated in FIG. 2, each connector-side coupler part 440 extends up to form a connector-side coupling space on its inner side, and a shell-side coupler part 650 is inserted into the connector-side coupling space. The connector ledge 450 may protrude inward from an upper portion of the connector-side coupler part 440 to engage the shell ledge 670 of the shell-side coupler part 650 positioned underneath. Of course, it is possible to change the shapes of the connector-side coupler parts 440 and the shell-side coupler parts 650 such that the connector ledges 450 protrude outward and the shell ledges 670 protrude inward.

Although it is not shown in FIG. 2 or FIG. 3, one or more detent indentations (not shown) can be formed in a connector ledge 450. A detent indentation (not shown) can be formed in a gradually curved, concave shape. When the elevation shell assembly is coupled to the container assembly, the detent protrusions (not shown) of the shell-side coupler parts 650, described later on, may be inserted into the detent indentations (not shown) of the connector ledges 450 to enable a more secure coupling.

The inner coupler parts 470 can be formed on a lower portion of the connector base 410 and can serve to both couple the connector 400 to the container body 1100 and secure the shaft 300. The inner coupler parts 470 can be formed in positions corresponding to the shaft 300, and the through hole can be formed on the inner side of the inner coupler parts 470. In the example illustrated in FIG. 2, clearance holes 475 are formed on both the left and right sides of the inner coupler parts 470.

With respect to the left-right direction, coupling protrusions 471 can be formed on the outer surfaces of the inner coupler parts 470, and placement ledges 473 can be formed on the inner surfaces of the inner coupler parts 470. The coupling protrusions 471 can engage the coupling protrusions 1162 of the container body 1100 to aid in securely coupling the connector 400 and the container body 1100, while the placement ledges 473 can support the shaft-side coupler part 350 when the shaft 300 has been lowered as much as possible.

The front block 480 may extend up from an upper portion on a front side of the connector 400 to cover the front of the connector-side coupler part 440 and the shaft-side coupler part 350. The front block 480 can extend along the edge of the connector base 410 and can be formed over the entire front side of the connector 400.

A contact surface (not shown) that faces the rear can be formed on at least one of a left side and a right side of the front block 480 in a shape similar to being cut away along a plane. The contact surface (not shown) can be formed with an incline with respect to the vertical direction and can be configured to contact the stopper surface (not shown) of the stopper block 680 formed on the elevation shell 600. In this embodiment, the connector 400 can include several connector-side coupler parts 440, and the contact surfaces (not shown) can be formed on the front block 480 that is formed over the entire front side of the connector 400.

In a stick container 2000 according to an embodiment of the invention, the container body 1100 can be coupled to the connector 400 and the screw guide 1200. Since the stick material 10 has a large width in an embodiment of the invention, a structure that includes a separate rotating part can be more convenient to use than a structure in which the container body itself is rotated. In this embodiment, the container body 1100 itself is not rotated, but rather a dial 1300 is exposed that is configured to be rotated by the user. Referring to FIG. 4A and FIG. 4B, a container body 1100 according to this embodiment can include a floor part 1110, an outer wall 1120, inner walls 1130, a securing cylinder 1140, broadened parts 1150, and coupling parts 1160.

The floor part 1110 can form the bottom surface of the container body 1100 and the overall stick container 2000, while the outer wall 1120 can extend up from the edge of the floor part 1110. The floor part 1110 and the outer wall 1120 can form portions of the exterior of the container body 1100 and stick container 2000. Coupling protrusions 1122 can be formed on the inner surface of the outer wall 1120. The coupling protrusions 1122 can engage the coupling protrusions 423 formed on the support cylinder 420 of the connector 400.

In an embodiment of the invention, an exposure recess 1125 can be formed in a lower portion of the container body 1100. The exposure recess 1125 can be open, for example, at the front, the rear, or both the front and rear of the container body 1100, and the outer wall 1120 can have a corresponding shape. In certain embodiments, the exposure recess 1125 can be omitted, and the dial 1300 can be exposed below the floor part 1110.

In cases where an exposure recess 1125 is formed in the container body 1100, the container body 1100 can include inner walls 1130 that define the exposure recess 1125. As illustrated in FIG. 4A and FIG. 4B, the inner walls 1130 and a platform 1132 formed at an upper portion of the inner walls 1130 can form the exposure recess 1125, in which the dial 1300 may be positioned.

The securing cylinder 1140 is the part that secures the screw guide 1200 therein. The securing cylinder 1140 can extend up from the floor part 1110 or from an upper surface of the platform 1132 and can have a hollow shape that is open at the top and bottom. The securing cylinder 1140 can follow a cylindrical shape at positions other than those corresponding to the broadened parts 1150, as illustrated in FIG. 4A and FIG. 4B, or can form a complete cylindrical shape even at the positions corresponding to where the broadened parts 1150 are present. A mounting space 1145 can be formed on the inner side of the securing cylinder 1140 into which the screw guide 1200 may be inserted. The securing cylinder 1140 can be designed such that the height of its upper end corresponds to the lower surface of the securing protrusions 1242 of the screw guide 1200.

The broadened parts 1150 can be formed on both sides of the securing cylinder 1140 in the shape of arcs having a diameter greater than that of the securing cylinder 1140, and the coupling parts 1160 can extend further upwards from the broadened parts 1150. Coupling protrusions 1162 can protrude outward at the upper portions of the coupling parts 1160, where the coupling protrusions 1162 can be used for the coupling between the container body 1100 and the connector 400.

The screw guide 1200 corresponds to the part that is rotated by the user's manipulation and moves the shaft 300 up and down. Referring to FIG. 5A and FIG. 5B, a screw guide 1200 according to this embodiment can include a guide base 1210, a socket cylinder 1240, a socket screw 1260, an outer ring 1280, and an inner ring 1290.

The guide base 1210 can have an annular shape and can support the remaining parts of the screw guide 1200.

The socket cylinder 1240 can extend up from the guide base 1210. The socket cylinder 1240 can be shaped as a hollow cylinder, and a socket space 1205 can be formed on the inside into which the extended body 310 of the shaft 300 can be inserted. The outer diameter of the socket cylinder 1240 can correspond to the inner diameter of the securing cylinder 1140. A socket screw 1260 can be provided on the inner side of the socket cylinder 1240, facing the socket space 1205.

Securing protrusions 1242 can protrude outward from an upper portion of the socket cylinder 1240, and clearance slits 1245 can also be formed in the upper portion of the socket cylinder 1240. Each clearance slit 1245 can extend from a particular position on the socket cylinder 1240 to the upper end of the socket cylinder 1240.

The socket screw 1260 can be formed on the inner side of the socket cylinder 1240. The socket screw 1260 can protrude inward from the inner side of the socket cylinder 1240 and can be formed in a helical shape to form a sort of female thread. The socket screw 1260 can be configured to mate with the shaft screw 360 of the shaft 300. It is possible to have the shaft screw 360 formed over the entire extended body 310 of the shaft 300 and have the socket screw 1260 formed only at a particular position, as in the example illustrated in the drawings, or conversely, it is possible to have the shaft screw 360 formed only at a particular position on the extended body 310 and have the socket screw 1260 formed over the entire inner perimeter of the socket cylinder 1240.

The outer ring 1280 and the inner ring 1290 can protrude down from a lower portion of the guide base 1210. The outer ring 1280 and the inner ring 1290 can be formed in annular shapes, where the outer ring 1280 can extend along the edge of the guide base 1210, and the inner ring 1290 can extend in an annular shape on the inner side of the outer ring 1280 at a slight distance from the outer ring 1280. The outer ring 1280 and the inner ring 1290 can be used in coupling the dial 1300 to the screw guide 1200. For example, as illustrated in FIG. 2 and FIG. 3, the inner ring 1380 of the dial 1300 can be pressed into the gap between the outer ring 1280 and the inner ring 1290.

One or more securing indentations 1285 can be formed in the outer ring 1280. When the dial 1300 is coupled to the screw guide 1200, the securing protrusions 1322 formed on the dial 1300 can be inserted into the securing indentations 1285, and the securing protrusions 1322 can transmit the rotational force applied on the dial 1300 onto the screw guide 1200.

The dial 1300 is a part that is coupled to the screw guide 1200 to be gripped and rotated by the user. Referring to FIG. 6, the dial 1300 can include a base 1310, a side wall 1320, and an inner ring 1380.

The base 1310 can form the bottom of the dial 1300 and can be generally shaped as a circular plate overall. The side wall 1320 can protrude up from the base 1310 and can extend along the edge of the base 1310. The side wall 1320 of the dial 1300 may correspond to the portion that is directly held by the user when the user wishes to manipulate the stick container 2000. In order that the user may rotate the dial 1300 more easily, grooves can be formed in the side wall 1320. As illustrated in FIG. 1A and FIG. 1B, the side wall 1320 of the dial 1300 can be exposed to the front and rear sides of the stick container 2000 by the exposure recess 1125 of the container body 1100.

One or more securing protrusions 1322 can be provided on the inner perimeter of the side wall 1320, where the securing protrusions 1322 can protrude inward. As described above, when the dial 1300 is coupled to the screw guide 1200, the securing protrusions 1322 can be inserted into the securing indentations 1285, and when the user rotates the dial 1300, the securing protrusions 1322 can transmit the rotational force to the screw guide 1200.

Although the example illustrated in the drawings is shown to have a structure in which the dial 1300 is coupled to the screw guide 1200 for convenient manufacture and for a more aesthetic appearance, it is also possible to form the dial 1300 as a part of the screw guide 1200. That is, the stick container 2000 does not necessarily have to include a separate dial 1300, and a portion of the screw guide 1200 can be exposed outside the container body 1100 to serve as the dial 1300.

FIG. 7 is a perspective view illustrating the container body 1100, screw guide 1200, and dial 1300 in a coupled state in a stick container 2000 according to an embodiment of the invention. Additionally coupling the shaft 300 and the connector 400 to the composition illustrated in FIG. 7 would complete the container assembly.

To assemble the container assembly, the manufacturer can first manufacture the shaft 300, connector 400, container body 1100, screw guide 1200, and dial 1300. Although these components have somewhat complicated shapes, every portion of each component is accessible from above or below and therefore can be manufactured without difficulty, for instance, by a molding process using an upper and a lower cast.

The dial 1300 can be coupled to a lower portion of the screw guide 1200. With the securing protrusions 1322 of the dial 1300 aligned with the securing indentations 1285 of the screw guide 1200, the manufacturer can press the screw guide 1200 and the dial 1300 towards each other, and after the inner ring 1380 of the dial 1300 is press-fitted between the outer ring 1280 and the inner ring 1290, the coupling protrusion formed around the outer perimeter of the guide base 1210 can be inserted in the coupling groove formed in the side wall 1320 of the dial 1300, thereby allowing the screw guide 1200 and the dial 1300 to be coupled to each other.

The connector 400 can be coupled to an upper portion of the container body 1100. The manufacturer can press the container body 1100 and the connector 400 towards each other such that the support cylinder 420 of the connector 400 is inserted into the open top of the container body 1100. As the coupling protrusions 423 of the support cylinder 420 engage the coupling protrusions 1122 of the outer wall 1120 and the coupling protrusions 471 of the inner coupler parts 470 engage the coupling protrusions 1162 of the coupling parts 1160, the container body 1100 and the connector 400 can be securely coupled.

In particular, when the connector 400 moves up so that the coupling protrusions 1162 of the coupling parts 1160 arrive at the coupling protrusions 471 of the inner coupler parts 470, the coupling parts 1160 can expand outward due to elastic deformation, and the inner coupler parts 470 can retract inward due to elastic deformation. During this process, the sloped surfaces at the upper portions of the coupling protrusions 1162 can move up along the sloped surfaces at the lower portions of the coupling protrusions 471, and once the coupling protrusions 1162 pass over the coupling protrusions 471, the lower surfaces of the coupling protrusions 1162 may be caught on the upper surfaces of the coupling protrusions 471.

The screw guide 1200 can be coupled to a lower portion of the container body 1100. The manufacturer can move the socket cylinder 1240 of the screw guide 1200 upward from the exposure recess 1125 to insert the socket cylinder 1240 into the mounting space 1145. Although the outer diameter of the socket cylinder 1240 may correspond to the inner diameter of the securing cylinder 1140, the securing protrusions 1242 may protrude outward from the outer perimeter at the upper portion of the socket cylinder 1240. However, clearance slits 1245 may be formed in the socket cylinder 1240, making it possible to insert the socket cylinder 1240 into the inner side of the securing cylinder 1140.

When the manufacturer inserts the socket cylinder 1240 into the inner side of the securing cylinder 1140, the socket cylinder 1240 can undergo elastic deformation such that the clearance slits 1245 contract to a narrower width, thus allowing the socket cylinder 1240 to enter the mounting space 1145. When the screw guide 1200 is moved to the end, the securing protrusions 1242 of the socket cylinder 1240 may reach the upper end of the securing cylinder 1140, so that the socket cylinder 1240 may elastically return to its original state, and the lower surfaces of the securing protrusions 1242 may be caught on the upper end of the securing cylinder 1140. In this state, the upper end of the dial 1300 may be located under the platform 1132.

When the screw guide 1200 is completely coupled to the container body 1100, the upper end of the socket cylinder 1240 may support the inner coupler parts 470 from the inside, so that the inner coupler parts 470 may no longer be easily deformed inward. Therefore, after the screw guide 1200 is coupled to the container body 1100, the connector 400 coupled to the container body 1100 may not be easily separated.

With the connector 400, container body 1100, screw guide 1200, and dial 1300 thus to one another, the manufacturer can couple the shaft 300 to the screw guide 1200. This can be achieved by inserting the extended body 310 of the shaft 300 through the through hole and into the socket space 1205 of the socket cylinder 1240. The manufacturer can have the shaft screw 360 of the shaft 300 mate with the socket screw 1260 of the socket cylinder 1240 and afterwards can rotate the shaft 300. Since the shaft 300 is unable to rotate relative to the connector 400 and the container body 1100, the shaft 300 can gradually move downward as the screw guide 1200 and the dial 1300 are rotated.

The elevation shell assembly of the stick container 2000 can house a content such as a sunscreen, deodorant, etc., in the form of a stick material 10 and can adjust the degree to which the stick material is exposed by moving the stick material 10 up or down in accordance with the manipulation made by the user. In an embodiment of the invention, the elevation shell assembly can compose a refill unit, and if the content is depleted in a stick container 2000, the elevation shell assembly with the depleted content can be replaced by a separate refill unit. Therefore, the elevation shell assembly can be configured to be detachably coupled to the connector 400 of the container assembly. The elevation shell assembly can mainly include an elevation shell 600 and a holder 700.

The elevation shell 600 can extend a particular length along the left-right direction and can also extend a particular length along the vertical direction. The elevation shell 600 can have an empty interior to thus define a shell space. The holder 700, and a content formed as a stick material 10 that is coupled to the holder 700, can be housed within the shell space. When using a stick container 2000 according to an embodiment of the invention, the user can hold the elevation shell 600 and/or the container body 1100 with one hand and grip the dial 1300 with the other hand before applying a manipulation of rotating these components relative to each other. The elevation shell 600 can include a shell body 610, shell-side coupler parts 650, and a stopper block 680.

The shell body 610, which may form the main part of the elevation shell 600, can be shaped as a hollow column. The shell body 610 can extend by particular lengths along the left-right direction and the vertical direction so as to have a shape that surrounds and houses the holder 700 and the stick material 10 that are held in the shell space. The top of the shell body 610 can be open, while the bottom of the shell body 610 can include a lower surface 620 that defines the lower limit of the shell space, where an insertion hole 630 and alignment holes 640 can be formed in the lower surface 620 of the shell body 610.

The holder-side coupler parts 740 of the holder 700 can be inserted in the insertion holes 630 formed in the lower surface 620 of the shell body 610. That is, the insertion hole 630 can provide a passage through which the holder-side coupler part 740 and the shaft-side coupler part 350 may be coupled to each other. First alignment protrusions 770 provided on the holder 700 can also be inserted in the insertion hole 630. That is, when the holder 700 is at its lowest position within the shell space, the first alignment protrusions 770 can be inserted in the insertion hole 630.

Second alignment protrusions 780 provided on the holder 700 can be inserted into the alignment holes 640 formed in the lower surface 620 of the shell body 610. That is, when the holder 700 is at its lowest position within the shell space, the second alignment protrusions 780 can be inserted in the alignment holes 640.

The shell-side coupler parts 650 can be provided on the lower surface 620 of the shell body 610 and can be configured to couple with the connector-side coupler parts 440 of the connector 400. In the context of this embodiment, a stick material 10 that is elongated along the left-right direction is housed by the elevation shell 600 and the connector 400, which are likewise also elongated along the left-right direction. Correspondingly, the elevation shell 600 can include a multiple number of shell-side coupler parts 650. The shell-side coupler parts 650 can be provided, one on each side of the insertion hole 630 through which the holder-side coupler part 740 passes, as in the example illustrated in FIG. 2. In certain embodiments, it is also possible to have one of the shell-side coupler parts 650 formed surrounding the insertion hole 630.

Each shell-side coupler part 650 can extend down from the lower surface 620 of the shell body 610, and a shell ledge 670 provided at a lower portion of the shell-side coupler part 650 can protrude in a horizontal direction. In the example illustrated in FIG. 2, the shell-side coupler parts 650 extend downward, surrounding the portions where the alignment holes 640 are formed. The shell ledges 670 may protrude outward from the lower portions of the shell-side coupler parts 650 to engage the connector ledges 450 of the connector-side coupler parts 440 that are positioned above. Of course, it is also possible to modify the shapes of the connector-side coupler parts 440 and shell-side coupler parts 650 such that the connector ledges 450 protrude outward and the shell ledges 670 protrude inward. Although it is not shown in FIG. 2 and FIG. 3, one or more detent protrusions (not shown) can be formed on the outer perimeter of a shell-side coupler part 650. A detent protrusion (not shown) can be formed in a gradually curved, convex shape. When the elevation shell assembly is coupled to the container assembly, the detent protrusions (not shown) of the shell-side coupler parts 650 may be inserted into the detent indentations (not shown) of the connector ledges 450 to enable a more secure coupling. The detent protrusions (not shown) can be formed at positions corresponding to the detent indentations (not shown) and can be formed at positions on an imaginary plane that divides the shell body 610 in half.

The stopper block 680 can extend down from a lower portion at the rear side of the shell body 610 to hide the rear of the shell-side coupler parts 650 and the holder-side coupler part 740. The stopper block 680 can extend along the edge of the lower surface 620 of the shell body 610 and can be formed over the entire rear side of the shell body 610. A stopper surface (not shown) that faces the front can be formed on at least one of a left side and a right side of the stopper block 680. The stopper surface (not shown) of the stopper block 680 can have the same incline as that of the contact surface (not shown) of the front block 480, and when the elevation shell assembly is coupled to the container assembly, the stopper surface (not shown) can be pressed against the contact surface (not shown), allowing the stopper block 680 and the front block 480 to form an integrated shape.

The holder 700 can be arranged in the shell space within the elevation shell 600 such that the holder 700 is movable along the vertical direction. The holder 700 can be configured to support the stick material 10 on an upper portion thereof. The holder 700 can have a portion thereof exposed through the insertion hole 630 of the elevation shell 600, where said portion can be configured to be coupled to the upper end of the shaft 300 when the elevation shell assembly is coupled to the container assembly. The holder 700 can include a holder body 720, an outer side wall 730, a holder-side coupler part 740, first alignment protrusions 770, and second alignment protrusions 780.

The holder body 720 can correspond to the main part of the holder 700 and can be arranged in the shell space on the inner side of the shell body 610. When the content is full within the elevation shell assembly, the holder body 720 can rest on the lower surface 620 of the shell body 610.

The holder body 720 can be shaped to have a concave middle. The holder body 720 can be concave in the middle with respect to the front-rear direction and with respect to the left-right direction so as to have an increased level of structural strength.

The outer side wall 730 can extend down from the edge of the holder body 720, thereby allowing the holder 700 to maintain a stable disposition within the shell space as well as preventing the content or other foreign substances from flowing down below the holder 700.

The holder-side coupler part 740 can be positioned at a point corresponding to the insertion hole 630 and can be configured to couple with the shaft-side coupler part 350 of the shaft 300. The holder-side coupler part 740 can extend down from a lower surface of the holder body 720, and a holder ledge 760 provided on its lower portion can protrude in a horizontal direction. In the example illustrated in FIG. 2, the holder-side coupler part 740 extends downward, and the holder ledge 760 extends outward from a lower portion of the holder-side coupler part 740 to engage the shaft ledge 390 of the shaft-side coupler part 350 that is positioned above. Of course, it is also possible to have the holder ledge 760 of the holder-side coupler part 740 protrude inward and have the shaft ledge 390 of the shaft-side coupler part 350 protrude outward.

The first alignment protrusions 770 and the second alignment protrusions 780 can be formed on a lower surface of the holder body 720 and can serve to secure the holder 700 in an aligned position when the holder 700 is at the lowest position within the shell space.

The first alignment protrusions 770 can protrude down from positions on the lower surface of the holder body 720 corresponding to the edge of the insertion hole 630. The holder-side coupler part 740 can be positioned on an inner side with respect to the first alignment protrusions 770, such that the first alignment protrusions 770 are formed around the holder-side coupler part 740. That is, the holder-side coupler part 740 can be formed in a position corresponding to the center of the insertion hole 630, and the first alignment protrusions 770 can be formed in positions corresponding to the edge of the insertion hole 630. Therefore, when the holder 700 is at the lowest position within the shell space, the first alignment protrusions 770 can be inserted into the insertion hole 630. The second alignment protrusions 780 can protrude down from positions on the lower surface of the holder body 720 corresponding to the alignment holes 640. When the holder 700 is at the lowest position within the shell space, the second alignment protrusions 780 can be inserted in the alignment holes 640.

The first alignment protrusions 770 and the second alignment protrusions 780 can serve to secure the holder 700, as well as the stick material 10 on the holder 700, before the elevation shell assembly is coupled to the container assembly, such as while the shell assembly is separated in the form of a refill unit, for example.

The cap assembly of the stick container 2000 can cover the exposed portions of the elevation shell assembly, so that the stick material 10 may be kept within a sealed space. The cap assembly can mainly include an inner cap 910 and an overcap 920.

The inner cap 910 can be coupled to an upper portion of the inner side of the overcap 920 and can seal the open top of the shell body 610 when the cap assembly is coupled to the container assembly. A sealing rim 912 that extends down along the edge of the inner cap 910 can be formed on a lower portion of the inner cap 910, and a sealing protrusion 914 that protrudes outward can be formed on a lower portion of the sealing rim 912. The sealing rim 912 and sealing protrusion 914 can contact the inner surface of the shell body 610 to tightly seal the shell space.

The overcap 920 can be implemented in the form of a cap that opens downward and can be configured to encase the container assembly. A coupling indentation can be formed in the inner perimeter of the overcap 920. When the cap assembly is coupled to the container assembly, a part of the inner cap 910 can be inserted to the inner side of the shell body 610, the lower end of the overcap 920 can rest on the upper end of the container body 1100, and the coupling protrusion of the connector 400 can be inserted into the coupling indentation of the overcap 920, so that the cap assembly may be detachably secured to the container assembly.

When coupling the elevation shell assembly of the refill unit to the container assembly after the stick material 10 is depleted in a stick container 2000 according to an embodiment of the invention, the user can separate the cap assembly, separate the elevation shell assembly in which the content has been depleted, and couple the new elevation shell assembly of the refill unit to the existing container assembly.

To this end, the user can move the holder 700 to the lowest position such that the shaft-side coupler part 350 is positioned under the lower surface 620 of the shell body 610 and then can pull and separate the elevation shell 600 and holder 700 rearward.

Next, the user can move the elevation shell assembly of the new refill unit in a front direction such that the shell ledges 670 engage the connector ledges 450 for coupling between the shell-side coupler part 650 and the connector-side coupler part 440 and the holder ledge 760 engages the shaft ledge 390 for coupling between the holder-side coupler parts 740 and the shaft-side coupler parts 350. As the refill unit is being moved forward, the detent protrusions (not shown) can be caught on the detent indentations (not shown) of the connector ledge 450. When the user exerts more force, the detent protrusions (not shown) and the connector ledges 450 may undergo slight elastic deformations, allowing the detent protrusions (not shown) to pass over the caught portion and be inserted into the detent indentations (not shown) formed in the connector ledges 450. When the refill unit reaches its correct position, the stopper surface (not shown) of the stopper block 680 can be pressed against the contact surface (not shown) of the front block 480.

As presented above, a stick container 2000 and a refill unit based on an embodiment of the invention allow the user to refill a stick material 10 such as a sunscreen or deodorant that has an elongated shape along the horizontal direction. A stick container 2000 according to an embodiment of the invention, despite requiring a relatively complicated structure, is composed of parts that can be easily assembled with a very simple maneuver and can maintain a high coupling strength after assembly. Due to the simple manner of refilling, the portions of the stick container having complicated structures can be reused, whereby both the consumer and the manufacturer can enjoy reductions in cost, the amount of wasted resources can be greatly reduced, and the amount of environmental pollution can also be reduced.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A refill unit configured to move in a front direction for coupling with a container assembly, the refill unit comprising:

an elevation shell extending a particular length along a left-right direction and along a vertical direction, the elevation shell defining a shell space therein, the shell space being open at an upper end thereof; and a holder disposed within the shell space and configured to be movable along the vertical direction, wherein the elevation shell comprises:

a shell body defining the shell space and having an insertion hole defined in a lower surface thereof; and a shell-side coupler extending downward from a lower surface of the shell body and including a shell ledge defined at a lower portion thereof and protruding in a horizontal direction, wherein the holder comprises:

a holder body disposed within the shell space; and a holder-side coupler extending downward from a lower surface of the holder body at a position corresponding to a center of the insertion hole, the holder-side coupler including a holder ledge defined at a lower portion thereof and protruding in a horizontal direction, wherein a first alignment protrusion is defined on the lower surface of the holder body at a position corresponding to an edge of the insertion hole, the first alignment protrusion extending downward, the holder-side coupler is at an inner side of the first alignment protrusion, and the first alignment protrusion is inserted in the insertion hole when the holder is at a lowest position within the shell space, wherein the holder-side coupler is exposed through the insertion hole below the lower surface of the shell body when the holder is at the lowest position within the shell space, and wherein the shell-side coupler is coupled with a connector of the container assembly and the holder-side coupler is coupled with a shaft of the container assembly when the refill unit is moved in the front direction towards the container assembly while the holder is at the lowest position within the shell space.

2. The refill unit of claim 1, wherein an alignment hole is defined in the lower surface of the shell body, the shell-side coupler is defined in a shape surrounding the alignment hole, a second alignment protrusion is defined on the lower surface of the holder body, and the second alignment protrusion is inserted in the alignment hole when the holder is at the lowest position within the shell space.

3. The refill unit of claim 1, wherein the elevation shell further comprises:

a stopper block extending downward from a lower portion on a rear side of the shell body to cover a rear side of the shell-side coupler, the stopper block including a stopper surface on at least one of a left side and a right side thereof, the stopper surface facing a front direction.

4. The refill unit of claim 1, wherein the shell ledge protrudes outward from the lower portion of the shell-side coupler, and at least one of a detent protrusion and a detent indentation is defined on an outer perimeter of the shell-side coupler.

5. The refill unit of claim 1, wherein the shell-side coupler extends downward to define a shell-side coupling space on an inner side thereof, the shell ledge protrudes in the horizontal direction from the lower portion of the shell-side coupler, the shell-side coupler is open at a front side thereof, and the shell-side coupling space is open at a top and a front side.

6. The refill unit of claim 5, wherein at least one of a detent protrusion and a detent indentation is defined on an inner perimeter of the shell-side coupler.

7. A refillable stick container configured to be coupled with a refill unit such that the refill unit moving in a front direction is coupled to an upper portion of the refillable stick container, the refillable stick container comprising:

an elevation shell extending a particular length along a left-right direction and along a vertical direction, the elevation shell defining a shell space therein, the shell space being open at an upper end thereof; and a holder disposed within the shell space and configured to be movable along the vertical direction, wherein the elevation shell comprises:

a shell body defining the shell space and having an insertion hole defined in a lower surface thereof; and a shell-side coupler extending downward from a lower surface of the shell body and including a shell ledge defined at a lower portion thereof and protruding in a horizontal direction, wherein the holder comprises:

a holder body disposed within the shell space; and a holder-side coupler extending downward from a lower surface of the holder body at a position corresponding to a center of the insertion hole, wherein a first alignment protrusion is defined on the lower surface of the holder body at a position corresponding to an edge of the insertion hole, the first alignment protrusion extending downward, the holder-side coupler is at an inner side of the first alignment protrusion, and the first alignment protrusion is inserted in the insertion hole when the holder is at a lowest position within the shell space, the refillable stick container further comprising:

a connector including a connector-side coupler and having a through hole defined in an upper surface thereof, the connector-side coupler configured to be coupled to an elevation shell of the refill unit;

a screw guide configured to be rotatable relative to the connector and including a socket cylinder, the socket cylinder defining a socket space on an inner side thereof and including a socket screw defined on an inner perimeter thereof; and a shaft including a shaft-side coupler and an extended body, the shaft-side coupler positioned above the through hole and configured to be coupled to a holder of the refill unit, the extended body having at least a portion thereof positioned within the socket space, the extended body including a shaft screw defined on a surface thereof, the shaft screw configured to mate with the socket screw, wherein the connector-side coupler extends upward from an upper surface of the connector and includes a connector ledge defined at an upper portion thereof, the connector ledge protruding in a horizontal direction, the shaft-side coupler extends upward from an upper portion of the extended body and includes a shaft ledge defined at an upper portion thereof, the shaft ledge protruding in a horizontal direction, and wherein the connector-side coupler is coupled with the elevation shell and the shaft-side coupler is coupled with the holder when the refill unit is moved in the front direction towards the connector.

8. The refillable stick container of claim 7, further comprising:

a container body coupled to the connector and the screw guide, wherein the container body is secured in relation to the connector, and the screw guide coupled to the container body is rotatable relative to the container body.

9. The refillable stick container of claim 7, wherein the shaft-side coupler extends upward to define a shaft-side coupling space on an inner side thereof, the shaft ledge protrudes inward from the upper portion of the shaft-side coupler, and the shaft-side coupler is open at a rear side thereof, the shaft-side coupling space being open at a top and a rear side.

10. The refillable stick container of claim 7, wherein the connector further comprises:

a front block extending upward from an upper portion on a front side of the connector to cover a front side of the shaft-side coupler.

11. The refillable stick container of claim 10, wherein the front block has a contact surface on at least one of a left side and a right side thereof, the contact surface facing a rear direction, the refill unit comprises a stopper block, the stopper block including a stopper surface facing a front side, and the stopper surface is pressed against the contact surface when the refill unit is coupled.

12. A refillable stick container comprising:

an elevation shell extending a particular length along a left-right direction and along a vertical direction, the elevation shell defining a shell space therein, the shell space being open at an upper end thereof;

a holder disposed within the shell space and configured to be movable along the vertical direction;

a connector including a connector-side coupler and having a through hole defined in an upper surface thereof, the connector-side coupler configured to be coupled to the elevation shell;

a screw guide configured to be rotatable relative to the connector and including a socket cylinder, the socket cylinder defining a socket space on an inner side thereof and including a socket screw defined on an inner perimeter thereof; and a shaft including a shaft-side coupler and an extended body, the shaft-side coupler positioned above the through hole and configured to be coupled to the holder, the extended body having at least a portion thereof positioned within the socket space, the extended body including a shaft screw defined on a surface thereof, the shaft screw configured to mate with the socket screw, wherein the elevation shell comprises:

a shell body defining the shell space and having an insertion hole defined in a lower surface thereof; and a shell-side coupler extending downward from a lower surface of the shell body and including a shell ledge defined at a lower portion thereof and protruding in a horizontal direction, wherein the holder comprises:

a holder body disposed within the shell space; and a holder-side coupler extending downward from a lower surface of the holder body at a position corresponding to a center of the insertion hole, the holder-side coupler including a holder ledge defined at a lower portion thereof and protruding in a horizontal direction, wherein a first alignment protrusion is defined on the lower surface of the holder body at a position corresponding to an edge of the insertion hole, the first alignment protrusion extending downward, the holder-side coupler is at an inner side of the first alignment protrusion, and the first alignment protrusion is inserted in the insertion hole when the holder is at a lowest position within the shell space, wherein the connector-side coupler extends upward from an upper surface of the connector and includes a connector ledge defined at an upper portion thereof, the connector ledge protruding in a horizontal direction, the shaft-side coupler extends upward from an upper portion of the extended body and includes a shaft ledge defined at an upper portion thereof, the shaft ledge protruding in a horizontal direction, wherein the holder-side coupler is exposed through the insertion hole below the lower surface of the shell body when the holder is at the lowest position within the shell space, and wherein the shell ledge engages the connector ledge to couple the shell-side coupler with the connector-side coupler and the holder ledge engages the shaft ledge to couple the holder-side coupler with the shaft-side coupler when the elevation shell is moved in a front direction towards the connector while the holder is at the lowest position within the shell space.

* * * * *